US011121494B2

(12) United States Patent
Kurita

(10) Patent No.: US 11,121,494 B2
(45) Date of Patent: Sep. 14, 2021

(54) CONTACT

(71) Applicant: Kitagawa Industries Co., Ltd., Aichi (JP)

(72) Inventor: Tomohisa Kurita, Aichi (JP)

(73) Assignee: Kitagawa Industries Co., Ltd., Aichi (JP)

( * ) Notice: Subject to any disclaimer, the term of this patent is extended or adjusted under 35 U.S.C. 154(b) by 0 days.

(21) Appl. No.: 16/982,325

(22) PCT Filed: Apr. 18, 2019

(86) PCT No.: PCT/JP2019/016565

§ 371 (c)(1),
(2) Date: Sep. 18, 2020

(87) PCT Pub. No.: WO2019/211988

PCT Pub. Date: Nov. 7, 2019

(65) Prior Publication Data

US 2021/0013658 A1 Jan. 14, 2021

(30) Foreign Application Priority Data

May 2, 2018 (JP) ..... JP2018-088795

(51) Int. Cl.
*H01R 4/48* (2006.01)
*H01R 13/24* (2006.01)
*H01R 4/02* (2006.01)

(52) U.S. Cl.
CPC ..... *H01R 13/2442* (2013.01); *H01R 4/02* (2013.01)

(58) Field of Classification Search
CPC .. H01R 13/2442; H01R 23/722; H01R 12/57; H01R 23/725; H05K 3/365; G03B 17/02
(Continued)

(56) References Cited

U.S. PATENT DOCUMENTS 6,065,980 A 5/2000 Leung et al.
7,156,705 B2 * 1/2007 Soh ..... H01R 13/2442 439/71

(Continued)

FOREIGN PATENT DOCUMENTS

EP 1381116 A1 12/2002
JP S58-178282 U 11/1983

(Continued)

OTHER PUBLICATIONS

International Preliminary Report on Patentability corresponding application No. PCT/JP2019/016565, dated Nov. 5, 2020 (English translation).

(Continued)

*Primary Examiner* — Phuong Chi Thi Nguyen
(74) *Attorney, Agent, or Firm* — Renner, Otto, Boisselle & Sklar, LLP

(57) ABSTRACT

A contact includes a thin plate member having elasticity and conductivity, is disposed between a first member and a second member, and electrically connects the first member and the second member via the thin plate member, and the contact includes a base portion and a movable portion. The base portion has a bonding surface to be bonded to the first member by soldering. The movable portion includes: a contact portion that contacts with the second member; and a connecting portion that connects to the base portion, and is configured to be elastically deformable with respect to the base portion. The connecting portion is gradually separated from the first member. A predetermined range from a connecting position of the connecting portion with the base portion is lower in solder wettability than the bonding surface.

8 Claims, 4 Drawing Sheets

(58) Field of Classification Search
USPC ..... 439/862, 66, 83, 74, 67, 515
See application file for complete search history.

(56) References Cited

U.S. PATENT DOCUMENTS

| | | | | |
|---|---|---|---|---|
| 10,707,627 | B2 * | 7/2020 | Nasiri Mahalati | H01F 38/14 |
| 10,741,951 | B2 * | 8/2020 | Mason | H01R 43/0256 |
| 10,910,748 | B2 * | 2/2021 | Mason | H05K 1/115 |
| 2005/0176309 | A1 * | 8/2005 | Soh | H05K 7/1069 439/862 |
| 2013/0084718 | A1 | 4/2013 | Kobayashi et al. | |

FOREIGN PATENT DOCUMENTS

| | | | |
|---|---|---|---|
| JP | 2001217535 | A | 8/2001 |
| JP | 2006-208062 | A | 8/2006 |
| JP | 2010-161010 | A | 7/2010 |
| JP | 2013-073882 | A | 4/2013 |

OTHER PUBLICATIONS

International Search Report for the corresponding application No. PCT/JP2019/016565, dated Jun. 4, 2019 with an English translation.
International Preliminary Report on Patentability corresponding application No. PCT/JP2019/016565, dated Mar. 24, 2020 (English translation to be provided once it becomes available).

* cited by examiner

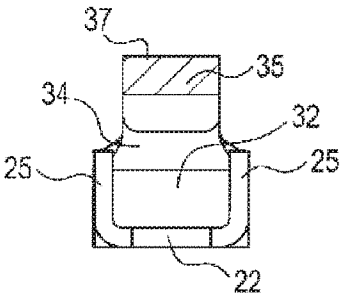
FIG. 2B
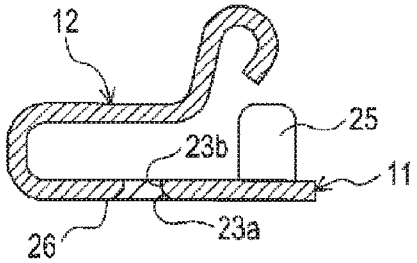
FIG. 2F
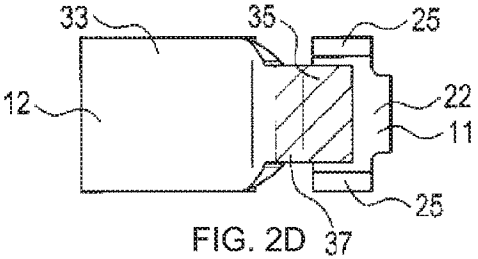
FIG. 2D
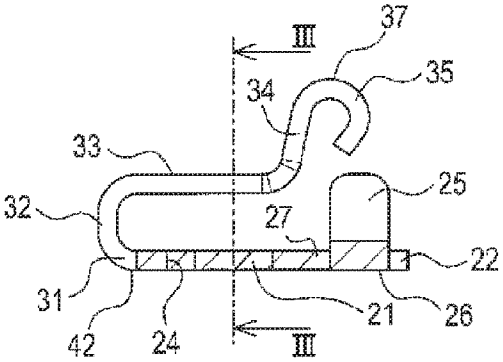
FIG. 2A
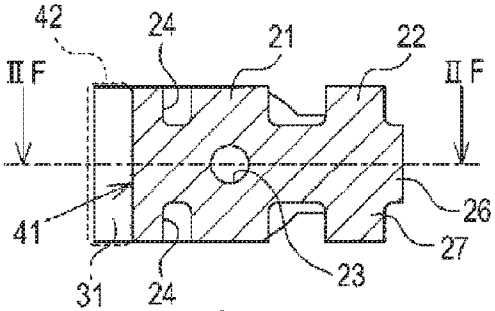
FIG. 2E
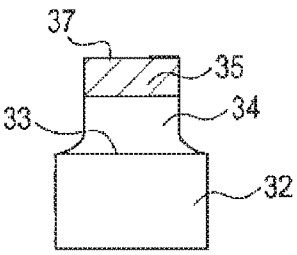
FIG. 2C
FIG. 2

CONTACT

This application is a national phase of International Application No. PCT/JP2019/016565 filed Apr. 18, 2019, which claims priority to Japanese Patent Application No. 2018-088795 filed May 2, 2018 in the Japan Patent Office, which are hereby incorporated herein by reference.

TECHNICAL FIELD

The present disclosure relates to a contact disposed between two members to electrically connect them.

BACKGROUND ART

A contact that electrically connects two members may be fixed to one of the members by soldering as described in Patent Document 1 below, for example.

CITATION LIST

Patent Literature

Patent Document 1: Japanese Unexamined Patent Application Publication No. 2001-217535 A

SUMMARY OF INVENTION

Technical Problem

Since it is difficult to make the distance between the two members completely constant, the contact is configured to be elastically deformable to appropriately connect the two members. It is desirable that an elastically deformable range of the contact is broad because the contact can be used for two members with a large tolerance of the distance described above. In addition, in recent years, the density of components mounted on a substrate has been increased in order to reduce the size of a device, and it is desired to reduce the size of a contact. However, when the size of a known contact is simply reduced, the elasticity is reduced, and the elastically deformable range is reduced.

An object of the present disclosure is to provide a contact capable of suppressing a decrease in elasticity.

Solution to Problem

One aspect of the present disclosure is a contact, which includes a thin plate member having elasticity and conductivity, which is bonded to a first member by soldering, disposed between the first member and a second member, electrically connects the first member and the second member via the thin plate member, and includes a base portion and a movable portion. The base portion has a bonding surface to be bonded to the first member. The movable portion includes: a contact portion that contacts with the second member; and a connecting portion that connects to the base portion, and is configured to be elastically deformable with respect to the base portion. The connecting portion is gradually separated from the first member. A predetermined range from a connecting position of the connecting portion with the base portion is lower in solder wettability than the bonding surface.

With such a configuration, since the connecting portion is less likely to be soldered, it is possible to prevent restriction of the elastic deformation of the connecting portion by soldering, and thus it is possible to prevent reduction in the elasticity of the entire movable portion.

The contact portion is provided at a position overlapping the base portion when the contact is projected onto a plane parallel to the bonding surface, and a length of the contact in a direction in which the connecting portion and the contact portion are connected may be 2 mm or less. With such a configuration, it is possible to suppress a decrease in elasticity due to soldering in a small contact.

The above-described base portion may be provided with a through-hole extending from the bonding surface to a surface opposite the bonding surface. With such a configuration, the melted solder enters the through-hole, thereby allowing to reduce the amount of the solder flowing out of the bonding surface, and thus it is possible to more effectively suppress the solder from attaching to the connecting portion.

The movable portion may include a parallel portion parallel to the bonding surface. The parallel portion may have a size that allows suction by a suction nozzle. With such a configuration, the contact can be arranged on the substrate or the like by automatic mounting using the suction nozzle.

At least a part of a side surface of the base portion may have higher wettability than that of the predetermined range. With such a configuration, soldering can be satisfactorily performed also on the side surface of the base portion, and the contact is hardly peeled off from the substrate or the like. In addition, since the melted solder easily flows to the side surface of the base portion, it is possible to more effectively suppress the solder from attaching to the connecting portion.

BRIEF DESCRIPTION OF DRAWINGS

FIG. 2A is a front view of the contact of the embodiment, FIG. 2B is a right side view, FIG. 2C is a left side view, FIG. 2D is a plan view, FIG. 2E is a bottom view, and FIG. 2F is a cross-sectional view taken along line IIF-IIF of FIG. 2E.

DESCRIPTION OF EMBODIMENTS

Figure 1:
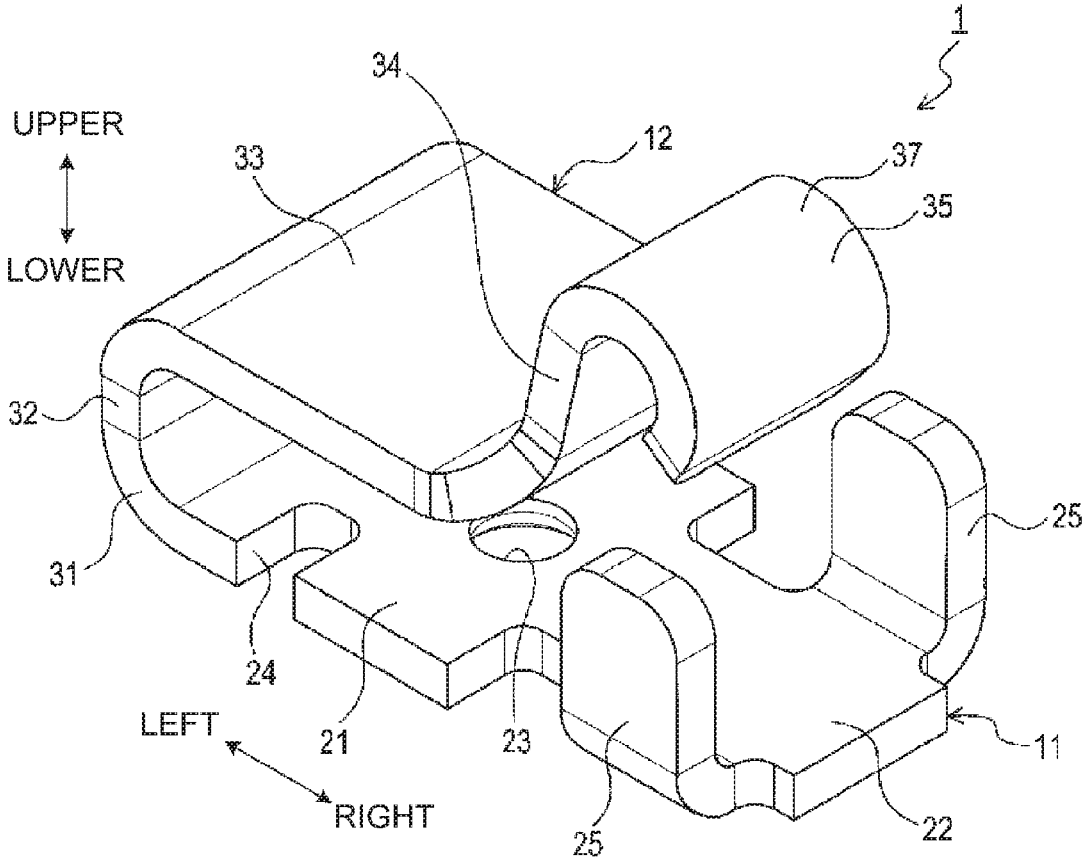
FIG. 1 is a perspective view illustrating a contact of an embodiment.

Hereinafter, embodiments of the present disclosure will be described with reference to the drawings.

1. Embodiment

1-1. Overall Configuration

The contact 1 illustrated in FIGS. 1 and 2A to 2E is a contact that can be surface-mounted on an electronic substrate by an automatic mounting machine. When the electronic substrate on which the contact 1 is surface-mounted is assembled to a housing or the like, the contact 1 comes into contact with the housing or other elements to electrically connect them to the electronic substrate.

The contact 1 is formed of a thin plate member having elasticity and conductivity. For example, it may be formed of a metal plate. The contact 1 includes a base portion 11 and a movable portion 12.

The base portion 11 is a portion that can be brought into contact with an electronic substrate when the contact 1 is surface-mounted on the electronic substrate. The main part of the base portion 11 has a flat plate shape. In addition, the length of the base portion 11 in the direction from one end portion to the other end portion thereof is greater than the length in the width direction intersecting therewith. Hereinafter, the configuration of the contact 1 will be described assuming that the one end described above is left and the other end is right.

The movable portion 12 extends from the left end portion of the base portion 11, turns back toward the right end portion, and the extended tip is located at a position facing the base portion 11. In other words, when the base portion 11 is bonded to the electronic substrate located therebelow, the main part of the movable portion 12 is located above the base portion 11. Hereinafter, the configuration of the contact 1 will be described by using a vertical direction as described above. Note that the vertical direction and the horizontal direction are merely used for convenience of description, and do not limit the usage of the contact 1.

1-2. Base

The base portion 11 includes a large width portion 21 having a relatively great length in the width direction and a small width portion 22 located on the right side of the large width portion 21 and having a width smaller than that of the large width portion 21.

The large width portion 21 is formed with a through-hole 23 penetrating in the thickness direction of the base portion 11. As illustrated in FIG. 2F, the through-hole 23 includes a lower portion 23*a* and an upper portion 23*b*, which have different shapes. The lower portion 23*a* is formed such that the hole diameter gradually increases downward, and the upper portion 23*b* has the same hole diameter as the upper end of the lower portion 23*a*, and its hole diameter does not change regardless of the vertical position. The hole diameter of the through-hole 23 may be, for example, 0.2 mm at the upper portion 23*b* and 0.3 mm at the lower end of the lower portion 23*a*.

Further, in the large width portion 21, notches 24 are formed at both ends in the width direction from the end portions in the width direction toward the center side. The notch 24 is provided in the vicinity of the left end of the base portion 11 at a position spaced apart from the left end.

A pair of protection pieces 25 extending upward are provided at both ends of the small width portion 22 in the width direction.

The base portion 11 has a bonding surface 26 which is a surface to be bonded to an electronic substrate by soldering. The lower surface of the large width portion 21 and the lower surface of the small width portion 22 correspond to the bonding surface 26. That is, the above-described through-hole 23 is a hole that extends from the bonding surface 26 to a surface (i.e., the upper surface) opposite the bonding surface of the base portion 11.

The base portion 11 is formed with a first plated portion 27 subjected to gold plating for improving solder wettability. The first plated portion 27 is a portion indicated by oblique lines in FIGS. 2A and 2E, and is formed not only on the lower surface of the large width portion 21 and the lower surface of the small width portion 22 (i.e., the bonding surface 26) but also on the side surfaces of the large width portion 21 and the small width portion 22, the inner peripheral surface of the through-hole 23, the inner wall surface of the notch 24, and the vicinity of the outer lower end of the protection piece 25. The metal used as the first plated portion 27 is not limited to gold, and other metals capable of improving wettability may be used.

Figure 3:
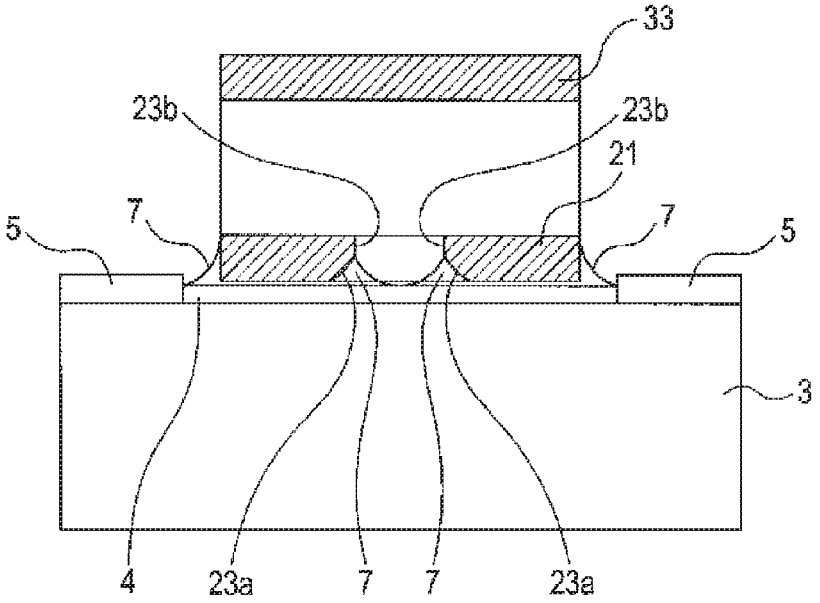
FIG. 3 is a cross-sectional view taken along line III-III of FIG. 2A, illustrating a state in which the contact is soldered to the first member.

FIG. 3 is a cross-sectional view illustrating the contact 1 soldered on a copper foil 4 provided on the electronic substrate 3. The electronic substrate is an example of a first member. Note that reference sign 5 denotes a resist. A solder fillet 7 is also appropriately formed on the side surface of the large width portion 21 and the inner peripheral surface of the through-hole 23 on which the first plated portion 27 is formed. Since the lower portion 23*a* of the through-hole 23 gradually increases in diameter downward, the solder melted in the reflow oven easily flows into and spreads in lower portion 23*a*. Although not illustrated, the fillet 7 is also formed on a side surface other than the right end side of the small width portion 22, and a lower end portion of the protection piece 25. Further, the entire bonding surface 26 is bonded to the electronic substrate 3 by soldering.

1-3. Movable Portion

The movable portion 12 includes a connecting portion 31, a vertical portion 32, a parallel portion 33, a sloped portion 34, and a contact portion 35 in this order from a portion adjacent to the base portion 11. In the following, unless otherwise specified, the shape of the movable portion 12 when no particular load is applied to the movable portion 12 will be described.

The connecting portion 31 is connected to the base portion 11 and extends from the base portion 11 while being bent in a direction intersecting the bonding surface 26. In other words, the connecting portion 31 is a portion that is bent to gradually separate from the electronic substrate 3 (or a virtual plane including the bonding surface 26) in a state where the contact 1 is bonded to the electronic substrate 3. A vertical portion 32 extending in the vertical direction is connected to the upper end of the connecting portion 31.

The parallel portion 33 extends rightward from the upper end of the vertical portion 32. The parallel portion 33 is parallel to the bonding surface 26 of the base portion 11. The parallel portion 33 is used as a suction surface when a suction nozzle of an automatic mounting machine sucks 1. Therefore, the parallel portion 33 is configured to have a size that allows suction by the suction nozzle. For example, in the parallel portion 33, a plane parallel to at least the large width portion 21 and the small width portion 22 may be 0.6 mm or more in both the left-right direction and the width direction.

The sloped portion 34 extends obliquely from the right end of the parallel portion 33 toward the upper right. Thus, the contact portion 35 can be provided at a position away from the base portion 11.

Figure 4:
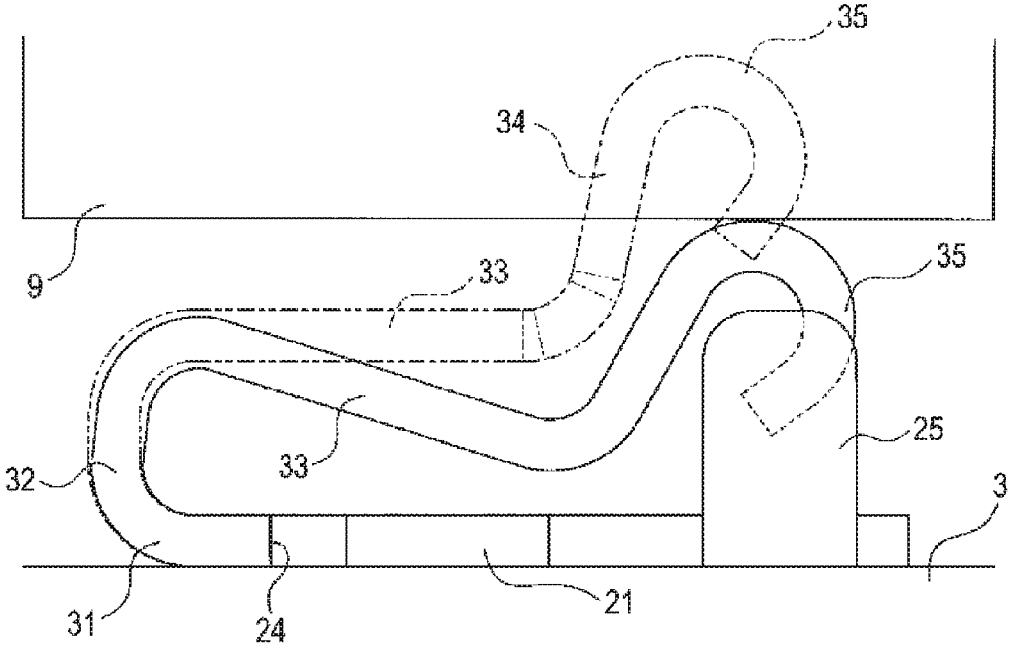
FIG. 4 is a front view illustrating the operation of the contact of the embodiment.

The contact portion 35 is provided on the upper end of the sloped portion 34, and has a curved surface shape that wraps downward from the viewpoint of FIG. 2A. As illustrated in FIG. 4, the contact portion 35 contacts, for example, a housing 9. The housing 9 is an example of a second member. The sloped portion 34 and the contact portion 35 are smaller in length in the width direction than the connecting portion 31, the vertical portion 32, and the parallel portion 33. For example, the width of the contact portion 35 may be 65% or less of the width of the large width portion 21 of the base portion 11. Consequently, the pressure per unit area of the contact portion 35 in contact with the housing 9 of the contact portion 35 is improved, and the flexibility of the sloped portion 34 and the contact portion 35 is relatively increased. When the width of the contact portion 35 is 50% or less of the width of the large width portion 21, the above-described effect becomes more remarkable.

The movable portion 12 is provided with a second plated portion 37 plated with gold at least on the upper surface of the contact portion 35. The movable portion 12 is a portion that is not fixed by soldering, but the second plated portion 37 is formed to enhance conductivity with the housing 9.

In addition, as illustrated in FIG. 2E, a plating process for forming gold plate to improve wettability is not performed on a non-bonding surface 42 which is a surface of the connecting portion 31 facing the electronic substrate 3 and which is a surface in a predetermined range from a connecting position 41 between the connecting portion 31 and the base portion 11. Therefore, the wettability of the non-bonding surface 42 of the connecting portion 31 is lower than the wettability of the bonding surface 26 or the like subjected to gold plating, thereby preventing solder bonding of the connecting portion 31.

As illustrated in FIG. 4, the movable portion 12 is elastically deformed with respect to the base portion 11 when a load is applied downward in contact with the housing 9. In this way, the contact 1 is disposed between the electronic substrate 3 and the housing 9, and electrically connects the electronic substrate 3 and the housing 9 via the thin plate member.

Here, since the connecting portion 31 is not soldered, the connecting portion 31 is also elastically deformed as compared with a case where the connecting portion is soldered. Since the movable portion 12 is elastically deformed by pivoting around the connecting portion 31, when the deformable displacement amount is increased in the connecting portion 31, the elastically deformable range of the movable portion 12 as a whole is greatly improved. That is, the elasticity of the base portion 11 is improved.

The pair of protection pieces 25 abuts on the housing 9 when the housing 9 excessively approaches the electronic substrate 3, and suppresses the housing 9 from further approaching the electronic substrate 3. This prevents the movable portion 12 from yielding and plastically deforming as a result of excessive displacement toward the base portion 11.

When the contact 1 is projected onto a plane parallel to the bonding surface 26, that is, in the viewpoint of FIG. 2D, the contact portion 35 is provided at a position overlapping the base portion 11. From the viewpoint of FIG. 2D, the contact 1 has a vertical length of 1.6 mm and a width length of 0.8 mm.

1-4. Method of Manufacturing Contact

Although the method of manufacturing the contact 1 is not particularly limited, one example will be described. When the contact 1 is manufactured, first, punching or bending by a press is performed on a coil material on which plating is not performed, and a formed product having a shape of the contact 1 for which an unnecessary portion is removed and bending or the like is performed is formed. The formed product is held in a state of being connected to a carrier by a bridge, and is formed into a pressed coil material. Next, the pressed coil material is subjected to a surface treatment for forming nickel plate which has a corrosion-inhibiting effect and is compatible with the gold plate. Subsequently, gold plate which is the first plated portion 27 and the second plated portion 37 is formed at positions of the bonding surface 26 and the contact portion 35. As a processing method of gold plating, a dry plating method such as sputtering can be used in addition to a wet plating method such as electroplating. By forming the gold plate, the solder wettability can be improved. After the gold plate is formed, the bridge is cut from the pressed coil material to form the contact 1. The cross section of the bridge is the right end face of the small width portion 22 of the base portion 11.

In addition, in order to effectively prevent the first plated portion 27 formed by gold plating from being provided on the non-bonding surface 42 of the connecting portion 31, a process of removing gold plate that is attached erroneously from the connecting portion 31 may be performed. For example, the gold plate of the connecting portion 31 may be removed by plasma treatment.

1-5. Effects

According to the embodiment described above in detail, the following effects can be obtained.

(1a) In the contact 1 of the present embodiment, since the connecting portion 31 is less likely to be soldered, it is possible to prevent the restriction of elastic deformation of the connecting portion 31 by soldering, and thus it is possible to prevent reduction in the elasticity of the entire movable portion 12. The contact 1 of the embodiment is 1.6 mm long, and particularly in such a small contact, a decrease in elasticity can be suppressed.

(1b) The contact 1 of the present embodiment can prevent the melted solder from flowing toward the connecting portion 31. Since the melted solder can flow into the through-hole 23 and the notch 24, the amount of solder flowing out of the bonding surface 26 is reduced. As a result, the solder can be more effectively prevented from attaching to the connecting portion 31.

In addition, since the surfaces of the through-hole 23 and the notch 24 are plated with gold, the wettability is improved and the flow of the solder is promoted.

In addition, since the gold plating process is also performed on the side surface of the base portion 11, the solder easily conforms to the side surface, an increase in the amount of the solder flowing to the connecting portion 31 can be suppressed, the soldering between the contact 1 and the electronic substrate 3 is satisfactorily realized, and the contact 1 is hardly peeled off from the electronic substrate 3.

(1c) In the present embodiment, the notch 24 is not provided to overlap the boundary portion between the base portion 11 and the connecting portion 31, that is, the connecting position 41. Thus, the connecting portion 31 is connected to the base portion 11 over the entire width of the connecting portion 31. In such a configuration, since the connecting portion 31 is firmly connected to the base portion 11, it is possible to reduce a risk that the connecting portion 31 is damaged when a load is applied to the movable portion 12.

(1d) In the present embodiment, a suction nozzle of an automatic mounting machine can be sucked to the parallel portion 33. Therefore, the contact 1 can be arranged on the electronic substrate 3 by an automatic mounting machine.

(1e) When the solder is melted by charging the contact 1 of the present embodiment into the reflow oven, the through-hole 23 and the notch 24 suppress the floating deviation, and the self-alignment that the contact 1 moves to an appropriate position on the electronic substrate 3 can be expected.

A non-bonding surface 42 of the connecting portion 31 is provided on the left side of the base portion 11, and the non-bonding surface 42 has low solder wettability. Therefore, a solder fillet is less likely to be formed between the left end of the base portion 11 and the electronic substrate 3. The right end surface of the base portion 11, that is, the right end surface of the small width portion 22 does not include a gold-plated portion at a cutting surface when the end surface is formed by cutting a metal plate material as a material of the contact 1 after the metal plate material is subjected to a surface treatment by gold plating. Therefore, it is difficult to form a fillet between the right end of the base portion 11 and the electronic substrate 3. As described above, the contact 1 is less likely to be displaced by being pulled by the solder fillets formed on the left and right sides of the base portion 11 when soldering is performed by reflow, and can be soldered at an expected position.

2. Other Embodiments

Although the embodiments of the present disclosure have been described above, the present disclosure is not limited to the above-described embodiments at all, and it is needless to say that the present disclosure can take various forms as long as they belong to the technical scope of the present disclosure.

(2a) The shape of the contact is not limited to the example illustrated in the above embodiment. For example, at least one of the through-hole 23, the notch 24, and the protection piece 25 may not be provided. The base portion 11 and the movable portion 12 may be modified in various forms. The through-hole 23 may be a hole in which the hole diameter does not change in the thickness direction of the base portion 11, or the hole diameter may change in the entire region in the thickness direction. The notch 24 may have a shape different from that of the above embodiment.

The size of the contact is not particularly limited. By adopting the features of the contact of the present disclosure in a contact having a vertical length of 2 mm or less, suppression of a decrease in elasticity is particularly effective.

(2b) In the above embodiment, the contact 1 is formed of a conductive thin plate member. However, the contact may include other elements such as synthetic resin as long as the function of electrically connecting the two members is not lost.

(2c) In the above-described embodiment, the first plated portion 27 plated with gold improves the wettability of the bonding surface 26 or the like, thereby creating a difference in wettability with the lower surface of the connecting portion 31. However, the specific method is not particularly limited as long as the degree of wettability can be changed. For example, the wettability may be improved by a surface treatment other than plating. In addition, the wettability of the bonding surface 26 or the like may be relatively increased by performing a surface treatment for reducing the wettability on the connecting portion 31.

The position of the surface treatment for changing the wettability, such as gold plating, is not limited to the position described in the above embodiment. For example, the gold plating process may not be performed in a part of the region where the first plated portion 27 is formed, such as the side surface of the base portion 11 or the inner peripheral surface of the through-hole 23. Further, a part of the bonding surface 26 may not be plated with gold. At least a part of the side surface of the base portion 11 may be configured to have higher solder wettability than the non-bonding surface 42.

The movable portion 12 may be gold-plated at a position other than the second plated portion 37.

(2d) In the above embodiment, the electronic substrate 3 is illustrated as an example of the first member, and the housing 9 is illustrated as an example of the second member. However, the first member and the second member are not limited to those illustrated. For example, not only the first member but also the second member may be an electronic substrate. The first member may be a housing and the second member may be an electronic substrate.

REFERENCE SIGNS LIST

1 Contact
3 Electronic substrate
4 Copper foil
5 Resist
7 Fillet
9 Housing
11 Base portion
12 Movable portion
21 Large width portion
22 Small width portion
23 Through-hole
**23*a*** Lower portion
**23*b*** Upper portion
24 Notch
25 Protection piece
26 Bonding surface
27 First plated portion
31 Connecting portion
32 Vertical portion
33 Parallel portion
34 Sloped portion
35 Contact portion
37 Second plated portion
41 Connecting position
42 Non-bonding surface

The invention claimed is:

1. A contact that includes a thin plate member having elasticity and conductivity, that is bonded to a first member by soldering and disposed between the first member and a second member, and that electrically connects the first member and the second member via the thin plate member, the contact comprising:

a base portion having a bonding surface to be bonded to the first member;

a movable portion including:

a contact portion that contacts with the second member; and a connecting portion that connects to the base portion, the movable portion being configured to be elastically deformable with respect to the base portion, wherein the connecting portion is a portion gradually separated from the first member, and a predetermined range from a connecting position of the connecting portion with the base portion is lower in solder wettability than the bonding surface, the base portion is formed with a through-hole extending from the bonding surface to a surface opposite the bonding surface, and a diameter of the through-hole gradually increases toward the bonding surface.

2. The contact according to claim 1, wherein the through-hole includes an upper portion and a lower portion having different shapes, the upper portion of the through-hole connected to the surface opposite the bonding surface is connected without a change in hole diameter to an upper end of the lower portion, a lower end of the lower portion connected to the bonding surface is formed such that the hole diameter gradually increases toward the bonding surface, and an inner peripheral surface of the through-hole is subjected to a treatment for improving solder wettability.

3. The contact according to claim 1, wherein at least a part of a side surface of the base portion has a higher solder wettability than the predetermined range.

4. The contact according to claim 3, wherein the through-hole includes an upper portion and a lower portion having different shapes, the upper portion of the through-hole connected to the surface opposite the bonding surface is connected without a change in hole diameter to an upper end of the lower portion, a lower end of the lower portion connected to the bonding surface is formed such that the hole diameter gradually increases toward the bonding surface, and an inner peripheral surface of the through-hole is subjected to a treatment for improving solder wettability.

5. The contact according to claim 1, wherein the contact portion is provided at a position overlapping the base portion when the contact is projected onto a plane parallel to the bonding surface, and a length of the contact in a direction connecting the connecting portion and the contact portion is 2 mm or less.

6. The contact according to claim 5, wherein the through-hole includes an upper portion and a lower portion having different shapes, the upper portion of the through-hole connected to the surface opposite the bonding surface is connected without a change in hole diameter to an upper end of the lower portion, a lower end of the lower portion connected to the bonding surface is formed such that the hole diameter gradually increases toward the bonding surface, and an inner peripheral surface of the through-hole is subjected to a treatment for improving solder wettability.

7. The contact according to claim 5, wherein at least a part of a side surface of the base portion has a higher solder wettability than the predetermined range.

8. The contact according to claim 7, wherein the through-hole includes an upper portion and a lower portion having different shapes, the upper portion of the through-hole connected to the surface opposite the bonding surface is connected without a change in hole diameter to an upper end of the lower portion, a lower end of the lower portion connected to the bonding surface is formed such that the hole diameter gradually increases toward the bonding surface, and an inner peripheral surface of the through-hole is subjected to a treatment for improving solder wettability.

* * * * *